US009986811B2

(12) United States Patent
Yang

(10) Patent No.: US 9,986,811 B2
(45) Date of Patent: Jun. 5, 2018

(54) CONTAINER FOR LIQUID COSMETICS

(71) Applicant: RICHCOS CO., LTD., Gyeonggi-do (KR)

(72) Inventor: Ha Suk Yang, Gyeonggi-do (KR)

(73) Assignee: RICHCOS CO., LTD., Gyeonggi-do (KR)

( * ) Notice: Subject to any disclaimer, the term of this patent is extended or adjusted under 35 U.S.C. 154(b) by 0 days. days.

(21) Appl. No.: 15/365,112

(22) Filed: Nov. 30, 2016

(65) Prior Publication Data

US 2018/0000226 A1 Jan. 4, 2018

(30) Foreign Application Priority Data

Jul. 4, 2016 (KR) ..... 10-2016-0084253

(51) Int. Cl.
*A45D 34/04* (2006.01)

(52) U.S. Cl.
CPC .... *A45D 34/045* (2013.01); *A45D 2200/1009* (2013.01)

(58) Field of Classification Search
CPC .... A45D 34/04; A45D 34/042; A45D 34/045; A45D 40/265
See application file for complete search history.

(56) References Cited

U.S. PATENT DOCUMENTS

| | | | | |
|---|---|---|---|---|
| 6,447,191 | B1 * | 9/2002 | Vasas | A45D 40/265 401/126 |
| 7,381,003 | B1 * | 6/2008 | Chang | A45D 40/0075 132/317 |
| 9,456,676 | B2 * | 10/2016 | Suzuki | A45D 40/265 |
| 2012/0011674 | A1 * | 1/2012 | Tanaka | A45D 34/045 15/207.2 |
| 2016/0022005 | A1 * | 1/2016 | Suzuki | A45D 40/265 401/126 |

FOREIGN PATENT DOCUMENTS

| | | |
|---|---|---|
| KR | 200384959 | 5/2005 |
| KR | 200437803 | 12/2007 |
| KR | 1020140103549 | 8/2014 |
| KR | 101524475 | 6/2015 |

* cited by examiner

*Primary Examiner* — Jennifer C Chiang
*Assistant Examiner* — Bradley Oliver
(74) *Attorney, Agent, or Firm* — IP & T Group LLP

(57) ABSTRACT

A container for liquid cosmetics may include a container unit having which includes a container which is filled with a liquid cosmetic product and combined with cup-shaped packing in which an accepting pit, through which discharging holes penetrate, is formed and a liquid cosmetic product applying unit which includes a cap combined with the container, is assembled so that a sponge, which is assembled to the front end of an inner cylinder elastically supported with elasticity of a compression spring assembled inside the cap, tightly comes in contact with the accepting pit of the packing to assume the shape of the accepting pit and protrudes, when the cap is removed, the inner cylinder to a predetermined distance to restore the sponge to its original state.

13 Claims, 5 Drawing Sheets

CONTAINER FOR LIQUID COSMETICS

CROSS-REFERENCE TO RELATED APPLICATIONS

The present application claims priority of Korean Patent Application No. 10-2016-0084253, filed on Jul. 4, 2016, which is incorporated herein by reference in its entirety.

BACKGROUND OF THE DISCLOSURE

Field of the Disclosure

The present disclosure relates to a container for liquid cosmetics and, more particularly, to a container for liquid cosmetics that protrudes, at the moment of removing a cap, a sponge wet with a liquid cosmetic product by means of the elasticity of a compression spring for prompt use, provides, when applying the cosmetic product, buffering functionality by means of the compression spring to guarantee convenience, retracts the sponge backward by compressing the compression spring to store the sponge when recapping the cap and maximizes tightness, reducing the length of the container, by means of the elasticity of the compression spring when recapping the cap.

Description of the Related Art

Lipsticks with various colors may be generally considered when referring to makeup products for lips. However, diverse liquid cosmetic products stored in a container have been commercialized such as lip care products with brilliant colors for caring lips according to use, lip glosses for young generation, lip balms, lip tins, lip plumpers, etc.

Such makeup products for lips have functions of preventing moisture on the lips from being evaporated, keeping the lips moistened by means of colored makeup and separating the lips from the outside, thereby protecting the lips from physical impact from the outside.

Patent Literatures 1 through 4 are exemplified regarding to the container for such liquid cosmetic products.

Patent Literature 1 discharges, by rotationally adjusting an operating knob, a certain amount of a liquid cosmetic product filled in a container unit to a puff of a discharging cap assembled to the front end of the container unit.

Patent Literature 2 includes a body that has a storing unit and a pressurizing member combined with the body in order to discharge, by pressurizing, a liquid cosmetic product so that a user can adjust the amount of the liquid cosmetic product discharged via a discharging groove of the pressurizing member when they pressurize the liquid cosmetic product contained in the body by using the pressurizing member.

Patent Literature 3 draws upward liquid contents absorbed in a porous absorption member to use the contents when a piston is raised by rotating a rotating body that pressurizes the absorption member.

Patent Literature 4 includes a storing space in a cap unit and a container unit, respectively, stores a cosmetic product in the cap unit besides the product stored in the container unit and has a rotating unit and a lifting and pressurizing unit that discharge the product via an applicator in order to help a user mix and use the cosmetic products with various forms and colors.

Each of the Patent Literatures 1 through 4 has a puff sponge, or applying pad, which is assembled to the front end of its container body for applying the liquid cosmetic product on the lips and an adjusting knob, or rotating body, which is assembled to the lower end or the outside of the container body and pushes the liquid cosmetic product filled in the container body so that the product is absorbed into the sponge, or applying pad, due to capillary action.

Such previous technologies require a rotating body or an adjusting knob that has the function of adjustment and should be rotated to absorb the liquid cosmetic product filled in the technologies into a sponge, or applying pad.

LIST OF RELATED ART DOCUMENTS

Patent Literature

Patent Literature 1: Korean Registered Utility Model No. 20-0384959 (Registered on May 16, 2005)

Patent Literature 2: Korean Registered Utility Model No. 20-0437803 (Registered on Dec. 20, 2007)

Patent Literature 3: Korean Publicized Patent No. 10-2014-0103549 (Publicized on Aug. 27, 2014)

Patent Literature 4: Korean Registered Patent No. 10-1524475 (Registered on May 26, 2015)

SUMMARY OF THE DISCLOSURE

To solve the problems in the previous technologies, the present disclosure provides a container for liquid cosmetics that protrudes, at the moment of removing a cap, a sponge wet with a liquid cosmetic product by means of the elasticity of a compression spring for prompt use, provides, when applying the cosmetic product, buffering functionality by means of the compression spring to guarantee convenience, retracts the sponge backward by compressing the compression spring to store the sponge when recapping the cap and maximizes tightness, reducing the length of the container, by means of the elasticity of the compression spring when recapping the cap.

The present disclosure also provides a container for liquid cosmetics that compresses a compression spring when storing a sponge after applying the liquid cosmetics and protrudes the sponge when applying the cosmetics on the lips in order to minimize the length of the container for liquid cosmetics.

The present disclosure also provides a container for liquid cosmetics with simplified components and assembling convenience to provide industrial mass production and economic feasibility.

To this end, a container for liquid cosmetics according to the present disclosure may include: a container unit which includes a container which is filled with a liquid cosmetic product and combined with cup-shaped packing in which an accepting pit, through which discharging holes penetrate, is formed; and a liquid cosmetic product applying unit which includes a cap combined with the container, is assembled so that a sponge, which is assembled to the front end of an inner cylinder elastically supported with elasticity of a compression spring assembled inside the cap, tightly comes in contact with the accepting pit of the packing to assume the shape of the accepting pit and protrudes, when the cap is removed, the inner cylinder to a predetermined distance to restore the sponge to its original state.

According to an embodiment of the present disclosure, the liquid cosmetic product applying unit may include: the inner cylinder which is elastically supported by the compression spring and has arc-shaped catching overhangs which protrude, from the external circumferential surface of the rear end of the inner cylinder, with a specific distance in between; a sponge housing which is assembled to the front end of the inner cylinder; the sponge which is mounted to and removed from the sponge housing; and an inner cap which is fastened to the external circumferential surface of the inner cylinder and, at the same time, to the internal circumferential surface of the cap not to be removed from the cap so that the inner cap is caught by the arc-shaped catching overhangs of the inner cylinder not to be displaced when the inner cap is protruded with elasticity of the compression spring.

According to another embodiment of the present disclosure, the inner cylinder may perfectly prevent the liquid cosmetic product absorbed in the sponge from leaking to the outside because the front end of the inner cylinder is inserted into the internal circumferential surface of the accepting pit of the cup-shaped packing and tightly sealed when the front end is pressed down to the surface with elasticity of the compression spring.

Here, the accepting pit has a larger diameter at the upper end, or is tapered, in order to make the front end of the inner cylinder press down to and come in contact tightly with the internal circumferential surface of the accepting pit with elasticity of the compression spring, thereby being sealed.

In addition, according to yet another embodiment of the present disclosure, a ring-shaped protrusion is formed on the top end portion of the cup-shaped packing, which presses the bottom portion of the end of the cap and may increase internal tightness, when the cap and the container are screw fastened to each other.

Furthermore, according to still another embodiment of the present disclosure, the cup-shaped packing may be made of low-density polyethylene (LDPE) or synthetic rubber, which has high water resistance.

The container for liquid cosmetics according to the present disclosure provides a convenient effect of carrying or storing in the liquid-tight state the sponge, as a tool for applying the liquid cosmetics on the lips of a user, wet with the liquid cosmetics and making the sponge automatically protrude when the cap is removed from the container in order to provide lipstick makeup.

Meanwhile, the present disclosure provides an effect of promoting portability in that the entire length of the container may be decreased to the extent possible.

In addition, the present disclosure provides simple composition of components, thereby providing an effect of industrial mass production and providing customers with the technology at a lower price.

Furthermore, the present disclosure minimizes hardening or deterioration of the liquid cosmetics filled in the container because the present disclosure maximizes the tightness when being carried and stored and at all times provides an advantageous effect of prompt use of the liquid cosmetics absorbed into the sponge by capillary action.

DETAILED DESCRIPTION OF THE EMBODIMENTS

Embodiments of the present disclosure are now described below more specifically with reference to FIGS. 1 through 5.

Figure 1:
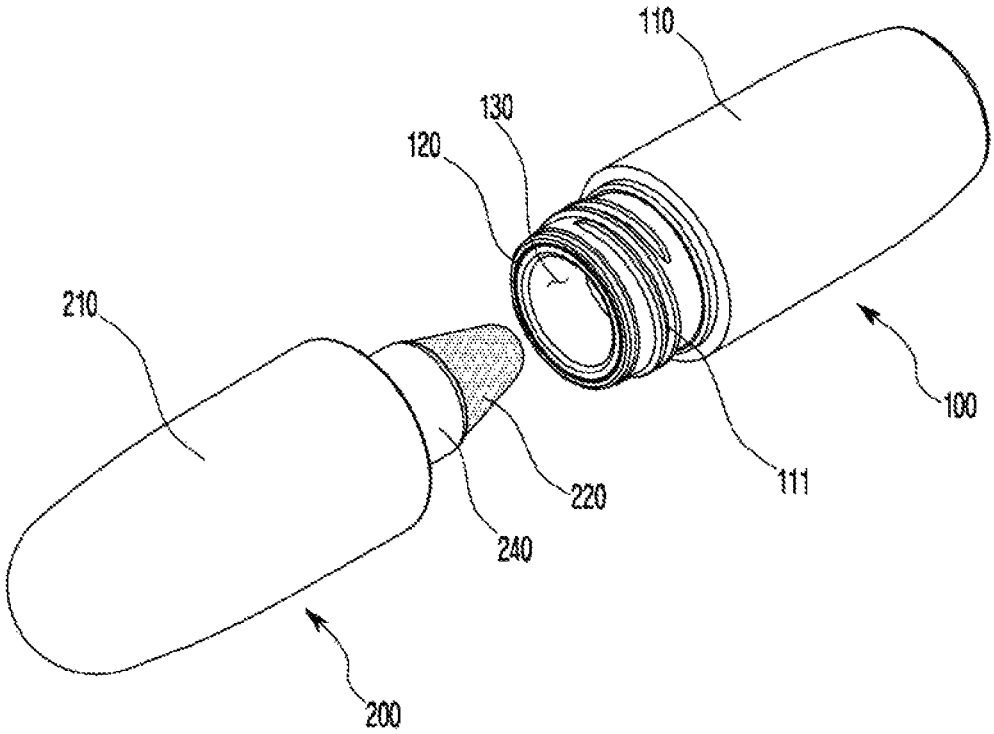
FIG. 1 is an exploded oblique view of a container unit and a liquid cosmetic product applying unit included in a container for liquid cosmetics according to an embodiment of the present disclosure.

A container for liquid cosmetics according to an embodiment of the present disclosure is a makeup tool, as illustrated in FIG. 1, for a user to remove a cap 210 from a container unit 100 and apply a liquid cosmetic product absorbed into a sponge 220 on their lips to keep their lips moistened.

Different from the previous technologies referred to above, the present disclosure automatically protrudes the sponge 220 of a liquid cosmetic product applying unit 200 included in the cap 210 and, when the liquid cosmetic product is stored, keeps the inside of the container unit tightly sealed and discharges the liquid cosmetic product C through packing 120 of the container unit 100 so that the liquid cosmetic product C is always absorbed into the sponge 220 to be applied to lips.

To this end, the present disclosure includes the container unit 100 and the liquid cosmetic product applying unit 200.

Figure 2:
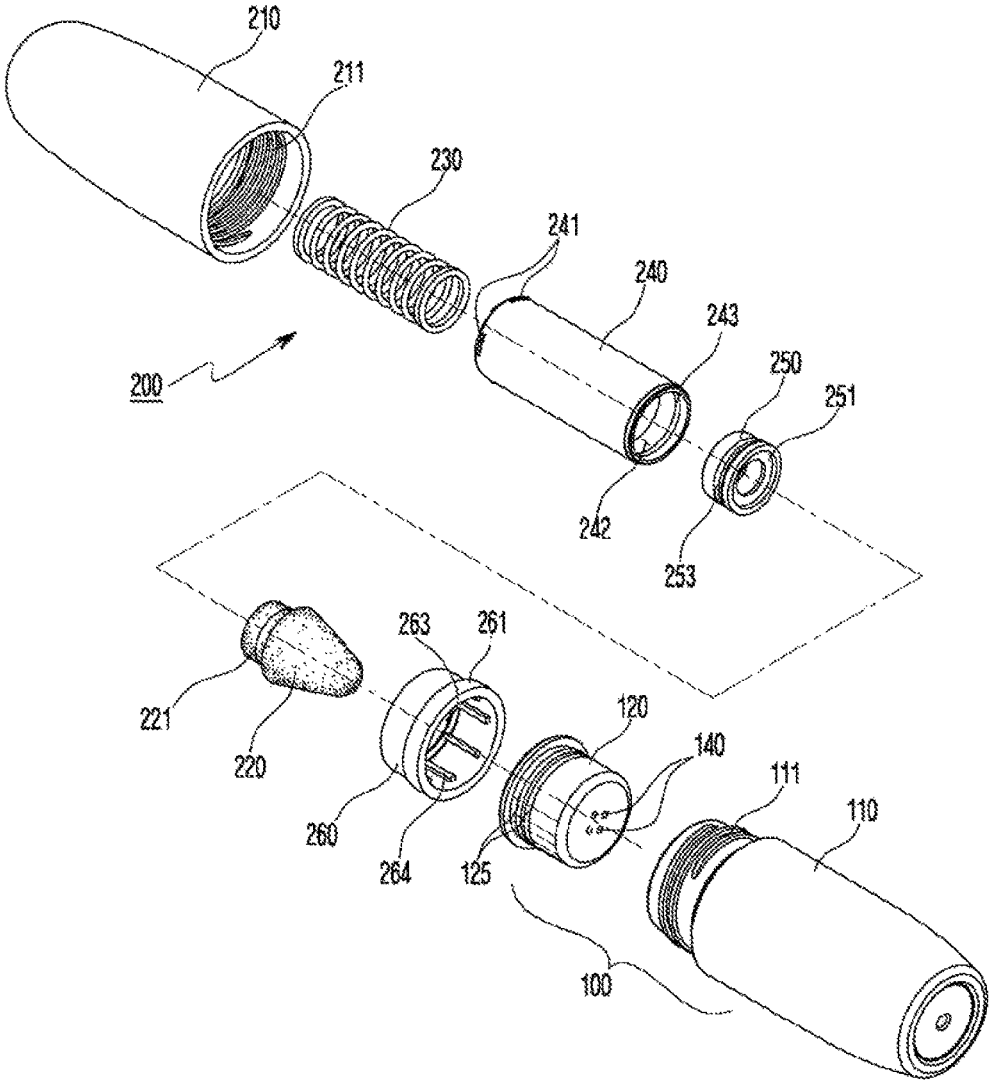
FIG. 2 is an exploded oblique view of components and members of the present disclosure.

As illustrated in FIG. 2, the container unit 100 is combined with the cup-shaped packing 120 which has discharging holes 140 which penetrate through the packing toward the entrance of the container 110 in which the liquid cosmetic product C is filled and an accepting pit 130.

The container 110 has threads 111 on the external circumferential surface of the entrance and a ring-shaped rounded protrusion 112 on the internal circumferential surface while the packing 120 has a pair of rounded protrusions 125 each of which is to be placed above and beneath, respectively, the rounded protrusion 112 so that the protrusions are assembled together by engaging with each other in order not to be removed from each other.

The packing 120 also has a ring-shaped pressing protrusion 122, which comes in contact tightly with the bottom surface of the cap 210, on an upper flange 121 of the packing.

The liquid cosmetic product applying unit 200 includes: the cap 210 that has threads 211 on the internal circumferential surface so that the cap is screw fastened to the threads 111 of the container 110 filled with the liquid cosmetic product C; a compression spring 230 and an inner cylinder 240 combined with the inside of the cap 210; a sponge housing 250 which is assembled to the front end of the inner cylinder 240; and the sponge 220 and an inner cap 260, as removable members, assembled to the sponge housing 250.

The inner cylinder 240 is inserted into the inside of the cap 210 when the inner cylinder is inserted into the inner cap 260, coming in contact with the internal circumferential surface of the inner cap, and elastically supported by the compression spring 230, where the inner cylinder 240 is capable of moving forward and backward by the inner cap 260 which is assembled to and not displaced from the internal circumferential surface of the cap 210.

The front end of the inner cylinder 240 protrudes by a predetermined distance from the inside of the cap 210 with elasticity of the compression spring 230, where the inner cylinder is not entirely removed from the cap because arc-shaped catching overhangs 241, which protrude from the external circumferential surface of the rear end of the inner cylinder with a specific distance in between, are caught by the rear end of the inner cap 260.

The inner cap 260 has a lower flange 261 the upper and lower surfaces of which are inserted and fixed between sill protrusions 212 that protrude from the internal circumferential surface of the cap 210 with a specific distance in between and a rounded protrusion 213 that protrudes below the sill protrusions.

In addition, the inner cap 260 has a central axis hole 263 formed by a sill 262, protruding toward the inside at the upper portion of the inner cap, through which the external circumferential surface of the inner cylinder 240 penetrates and guide protrusions 264 which have a height identical to the height of the sill 262 and are longitudinally placed on the internal circumferential surface of the inner cap with a specific distance in between on the lower side of the central axis hole 263.

Due to the structure of the inner cap 260, it is possible to minimize friction between the inner cap and the outer circumferential surface of the inner cylinder 240 that moves forward and backward because the outer circumferential surface is partially supported by the sill 262 and the guide protrusions 264 and it is also possible to lighten the container.

The inner cylinder 240 is hollow at the center and has a housing pit 242 one side of which is occluded to be assembled with the sponge housing 250.

Here, a rounded protrusion 243 protrudes from the internal circumferential surface of the housing pit 242 while a rounded protrusion 253, which is to engage with the inner side of the rounded protrusion 243, protrudes from the external circumferential surface of the sponge housing 250 so that the rounded protrusions 243, 253 are firmly assembled with each other when the sponge housing is inserted into the housing pit.

Meanwhile, a ring-shaped sill 251 protrudes from the internal circumferential surface of the sponge housing 250 while a cut section 221 is formed at the sponge 220 and inserted into the ring-shaped sill 251 to fix the sponge.

It is possible, due to such a fixing structure, to place and fix the sponge 220 accurately in the sponge housing 250, thereby minimizing defective rate.

Figure 3:
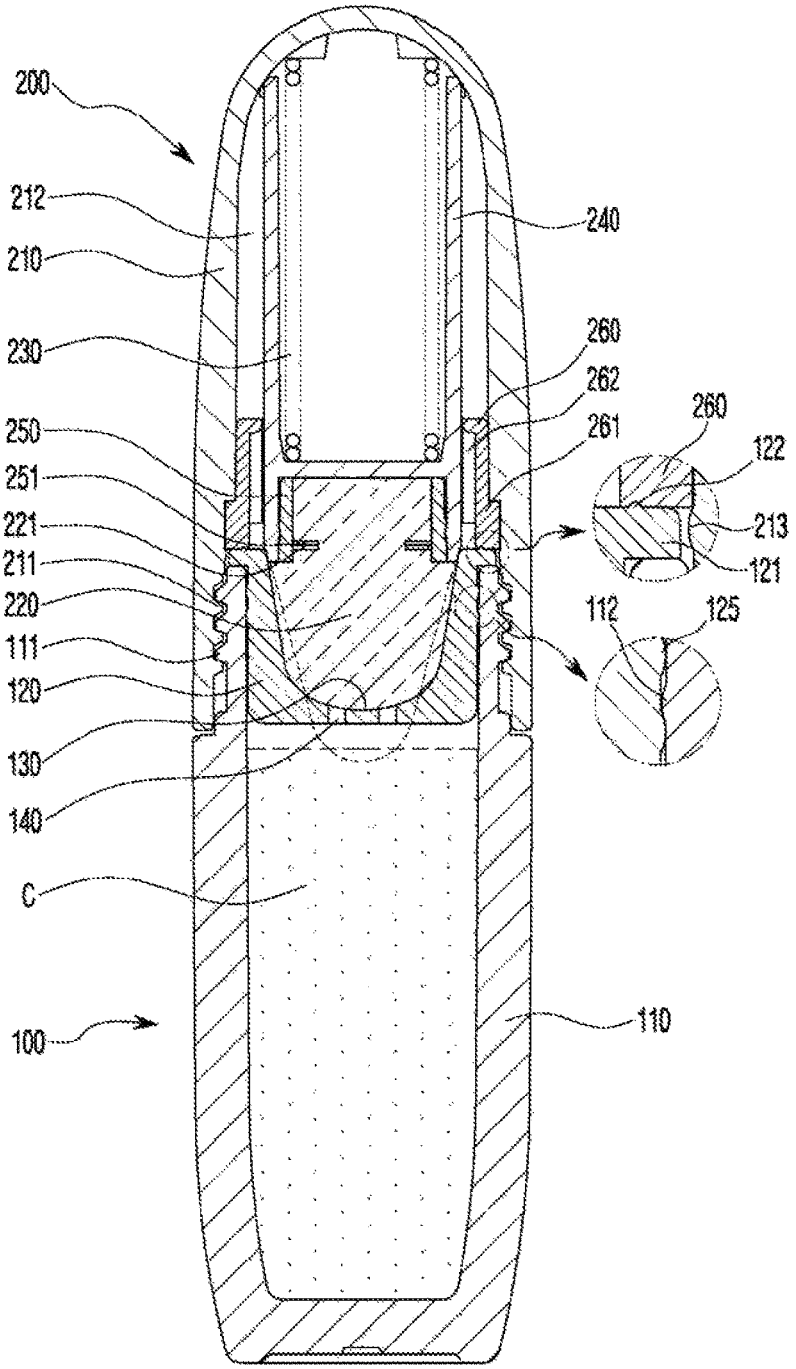
FIG. 3 is a cross-sectional view of the present disclosure which illustrates the state in which the present disclosure is carried or stored.
Figure 4:
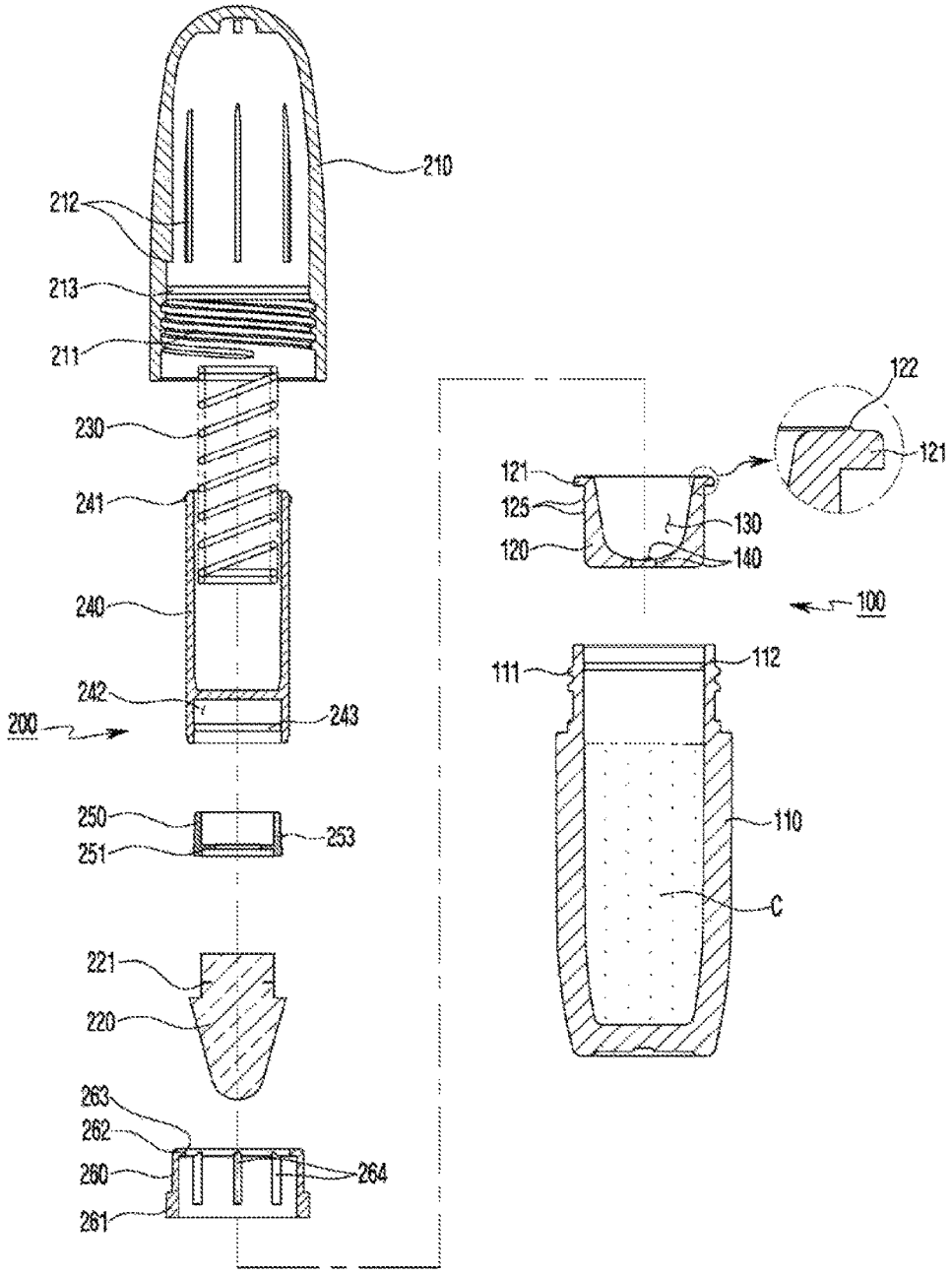
FIG. 4 is a cross-sectional exploded view of the present disclosure.

As illustrated in FIG. 3, the inner cylinder 240 is extruded to the outside with elasticity of the compression spring 230 and the threads 111 formed on the external circumferential surface of the container 110 screw fastened to the threads 211 formed on the internal circumferential surface of the cap 210, which makes the sponge 220 come in contact tightly with the accepting pit 130 of the packing 120 so that the sponge is compressed and assembled in the shape of the accepting pit 130.

In the assembly, the ring-shaped protrusion 122 protruded from the top end portion of the cup-shaped packing 120 presses down the bottom portion of the end of the cap 210, thereby providing internal tightness to a great extent.

The cup-shaped packing 120 may be made of low-density polyethylene (LDPE) or synthetic rubber, which has high water resistance.

When the container 110 and the cap is assembled in the way described above, tightness is provided because the front end of the inner cylinder 240 comes in contact tightly with the accepting pit 130 of the cup-shaped packing 120 and, due to the tightness, the liquid cosmetic product C is stored, not being leaked to the outside, even when the liquid cosmetic product C is discharged via the discharging holes 140 to the accepting pit 130 of the packing 120 to be absorbed into the sponge 220.

Figure 5:
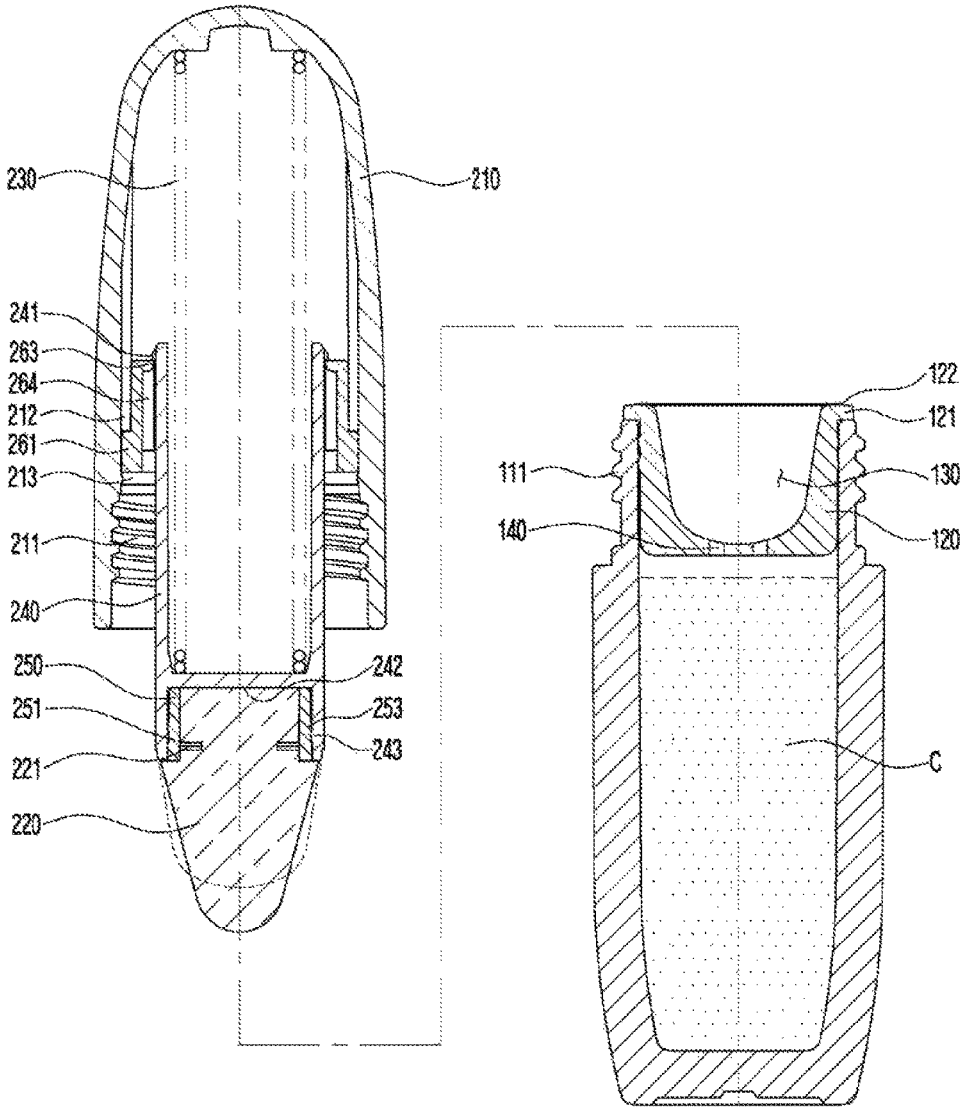
FIG. 5 is a cross-sectional view of a sponge which has protruded when the present disclosure is used and the liquid cosmetic product applying unit is removed from the container unit.

From such a storing state, the user may unscrew the cap 210 from the container 110, for using the liquid cosmetic product, in order to protrude the inner cylinder 240 elastically supported by the compression spring 230 and restore the sponge 220 assembled to the sponge housing 250 combined with the front end of the inner cylinder 240 to the original state, as illustrated in FIG. 5.

The sponge 220 is tapered, like a cone, to have the least diameter at its front end and may be used for applying the absorbed liquid cosmetic product C on the lips.

As described thus far, the container for liquid cosmetics according to the present disclosure provides an advantageous effect of applying the cosmetics without delay when the cap 210 is unscrewed from the container 110 and, at the same time, the sponge 220 for lip makeup is protruded, or exposed, by a specific distance, from the inside of the cap 210 to the outside due to elasticity of the compression spring 230.

The present disclosure also provides promptness as well as convenience in that the container may be safely carried or stored in a purse due to the definite tight structure, without external leakage of the liquid cosmetics and the user may use the cosmetics without delay upon unscrewing the cap 210 from the container 110.

Although the present disclosure has been described thus far with reference to the embodiments illustrated in the drawings, the present disclosure must not be limited thereto and may be changed and modified within the scope of the present disclosure. Any change or modification from the present disclosure should be included in the thoughts and technology of the present disclosure.

What is claimed is:

1. A container for liquid cosmetics comprising:

a container unit which includes a container which is filled with a liquid cosmetic product and combined with cup-shaped packing in which an accepting pit, through which discharging holes penetrate, is formed; and a liquid cosmetic product applying unit which includes a cap combined with the container, is assembled so that a sponge, which is assembled to the front end of an inner cylinder elastically supported with elasticity of a compression spring assembled inside the cap, tightly comes in contact with the accepting pit of the packing to assume the shape of the accepting pit and protrudes, when the cap is removed, the inner cylinder to a predetermined distance to restore the sponge to its original state, wherein the inner cylinder is hollow at the center and has a housing pit one side of which is occluded to be assembled with a sponge housing, and a rounded protrusion protrudes from the internal circumferential surface of the housing pit while a rounded protrusion, which is to engage with the inner side of the rounded protrusion, protrudes from the external circumferential surface of the sponge housing so that the rounded protrusions are firmly assembled with each other when the sponge housing is inserted into the housing pit.

2. The container for liquid cosmetics of claim 1, wherein a ring-shaped protrusion is formed on the top end portion of an upper flange of the cup-shaped packing to press the bottom surface of the end of the cap and increase internal tightness when threads formed in the container and the cap are screw fastened to each other.

3. The container for liquid cosmetics of claim 1, wherein a ring-shaped sill protrudes from the internal circumferential surface of the sponge housing while a cut section is formed at the sponge and inserted into the ring-shaped sill in order to fix the sponge.

4. The container for liquid cosmetics of claim 1, wherein the front end portion of the inner cylinder is inserted into the internal circumferential surface of the accepting pit of the cup-shaped packing and compressed to tightly come in contact with the surface by means of elasticity of the compression spring in order to prevent external leakage of the liquid cosmetic product absorbed into the sponge.

5. The container for liquid cosmetics of claim 1, wherein the accepting pit has a larger diameter at the upper end, or is tapered, in order to make the front end of the inner cylinder press down to and come in contact tightly with the internal circumferential surface of the accepting pit with elasticity of the compression spring, thereby being tightly sealed.

6. The container for liquid cosmetics of claim 1, wherein an inner cap has a lower flange the upper and lower surfaces of which are inserted and fixed between sill protrusions that protrude from the internal circumferential surface of the cap with a specific distance in between and a rounded protrusion that protrudes below the sill protrusions.

7. A container for liquid cosmetics comprising:

a container unit which includes a container which is filled with a liquid cosmetic product and combined with cup-shaped packing in which an accepting pit, through which discharging holes penetrate, is formed; and a liquid cosmetic product applying unit comprising an inner cylinder which is elastically supported by a compression spring and has arc-shaped catching overhangs which protrude, from the external circumferential surface of the rear end of the inner cylinder, with a specific distance in between, a sponge housing which is assembled to the front end of the inner cylinder, a sponge which is mounted to and removable from the sponge housing and an inner cap which is fastened to the external circumferential surface of the inner cylinder and, at the same time, to the internal circumferential surface of a cap not to be removed from the cap so that the inner cap is caught by the arc-shaped catching overhangs of the inner cylinder not to be displaced when the inner cap is protruded with elasticity of the compression spring, wherein the inner cylinder is elastically supported by elasticity of the compression spring in order to make the sponge tightly come in contact with the accepting pit of the packing and be assembled when the sponge is compressed into the shape of the accepting pit, and, when the cap is removed, the sponge is protruded and restored to the original state to perform lip makeup when the arc-shaped catching overhangs of the inner cylinder are caught by the external circumferential surface of the rear end portion of the inner cap.

8. The container for liquid cosmetics of claim 7, wherein a ring-shaped protrusion is formed on the top end portion of an upper flange of the cup-shaped packing to press the bottom surface of the end of the cap and increase internal tightness when threads formed in the container and the cap are screw fastened to each other.

9. The container for liquid cosmetics of claim 7, wherein the inner cylinder is hollow at the center and has a housing pit one side of which is occluded to be assembled with the sponge housing, and a rounded protrusion protrudes from the internal circumferential surface of the housing pit while a rounded protrusion, which is to engage with the inner side of the rounded protrusion, protrudes from the external circumferential surface of the sponge housing so that the rounded protrusions are firmly assembled with each other when the sponge housing is inserted into the housing pit.

10. The container for liquid cosmetics of claim 9, wherein a ring-shaped sill protrudes from the internal circumferential surface of the sponge housing while a cut section is formed at the sponge and inserted into the ring-shaped sill in order to fix the sponge.

11. The container for liquid cosmetics of claim 7, wherein the front end portion of the inner cylinder is inserted into the internal circumferential surface of the accepting pit of the cup-shaped packing and compressed to tightly come in contact with the surface by means of elasticity of the compression spring in order to prevent external leakage of the liquid cosmetic product absorbed into the sponge.

12. The container for liquid cosmetics of claim 7, wherein the accepting pit has a larger diameter at the upper end, or is tapered, in order to make the front end of the inner cylinder press down to and come in contact tightly with the internal circumferential surface of the accepting pit with elasticity of the compression spring, thereby being tightly sealed.

13. The container for liquid cosmetics of claim 7, wherein the inner cap has a lower flange the upper and lower surfaces of which are inserted and fixed between sill protrusions that protrude from the internal circumferential surface of the cap with a specific distance in between and a rounded protrusion that protrudes below the sill protrusions.

* * * * *